United States Patent [19]

Stanwick

[11] 4,160,613

[45] Jul. 10, 1979

[54] PILE ANCHOR FOR MOORINGS

[76] Inventor: Tad Stanwick, 1735 K St. NW., Washington, D.C. 20006

[21] Appl. No.: 918,616

[22] Filed: Jun. 23, 1978

[51] Int. Cl.[2] ..... E02D 5/74; E02D 27/50

[52] U.S. Cl. ..... 405/244; 52/160; 405/259

[58] Field of Search ..... 405/244, 259, 260, 261; 52/160, 698, 704; 175/284, 285, 286, 279; 114/294–311

[56] References Cited

U.S. PATENT DOCUMENTS

| | | | |
|---|---|---|---|
| 1,982,687 | 12/1934 | O'Brien | 52/160 X |
| 2,053,698 | 9/1936 | Church | 175/285 |
| 2,450,223 | 9/1948 | Barbour | 175/285 X |
| 2,997,119 | 8/1961 | Goodwin | 175/286 X |
| 3,336,989 | 8/1967 | Henderson | 175/286 X |

FOREIGN PATENT DOCUMENTS

| | | | |
|---|---|---|---|
| 1236439 | 6/1960 | France | 405/259 |

*Primary Examiner*—Dennis L. Taylor
*Attorney, Agent, or Firm*—David H. Semmes

[57] ABSTRACT

A pile anchor for moorings of the type which includes a flexible housing in combination with both a bellis expander and a pair of pivotable flukes extending through apertures in the housing. As load is placed upon the anchor cable, the anchor stock is reciprocated within the housing to expand the bellis against the housing sides which are pushed against the pile hole. Simultaneously the anchor flukes are pivoted to extend through the housing apertures and engage the sides of the pile hole. A pair of such bellis expanders may be employed together with a pair of pivotable flukes to assure positive gripping expansion of the piling assembly with the sides of the pile hole.

11 Claims, 2 Drawing Figures

PILE ANCHOR FOR MOORINGS

CROSS-REFERENCES TO RELATED APPLICATIONS

A continuation-in-part of applicant's METHOD OF GENERATING ROTARY POWER IN A DEEP-SEA ENVIRONMENT (Ser. No. 907,062), filed May 17, 1978. The present pile anchor assembly may be carried upon the power generating apparatus, illustrated in the parent application, and then dropped into the piling hole. The piling is secured in the hole upon placement of longitudinal load upon the anchor cable and stock, so as to expand the bellis assemblies and pivot the anchor flukes into engagement with the piling hole wall.

BACKGROUND OF THE INVENTION (1). Field of the Invention

Embedding anchors, particularly expansible anchors which engage the sides of a piling hole drilled within a deepsea environment.

(2). Description of the Prior Art

Being submitted separately under the provisions of 37 C.F.R. 1.97.

SUMMARY OF THE INVENTION

According to the present invention pile anchors for moorings may be secured within pile holes which are cut or drilled into the ocean bottom with a deepsea environment, for example 1,000 fathoms or more. At such depths, conventional methods of anchor securement, such as dragging, mechanical or explosive embedment are impractical, if not impossible. The present pile anchor is in the form of a cylindrical, flexible housing. The anchor cable extends axially of the housing, so as to suspend an anchor stock at the bottom of the housing. A combined bellis'expander assembly and a pair of pivoted flukes are actuated as longitudinal load is placed upon the anchor cable. As this load is placed, the bellis expands against the sides of the flexible housing, thus urging the housing against the pile hole wall, and the anchor flukes are outwardly of the housing to engage the pile hole wall. Two such bellis expanders or pivoted link equivalents may be employed, one above the anchor stock and the other beneath the anchor stock, such that the pile holes inner wall is positively engaged by the expanded housing above and below the free engagement of the anchor flukes with the walls of the hole. Modifications of invention include the support of a chafing collar around the housing at the top of the pile hole. The bellis or link assemblies are pivoted upon bearing plates mounted within the housing.

DESCRIPTION OF THE PREFERRED EMBODIMENTS

Figure 1:
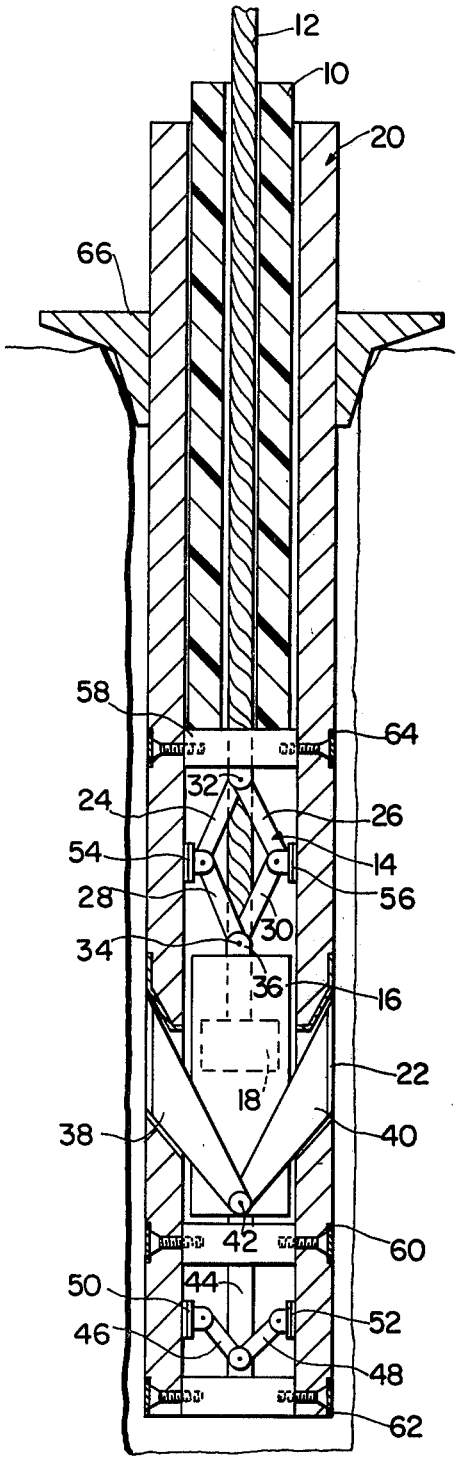
FIG. 1 is a partially fragmentary, vertical elevation, showing the pile anchor upon being placed in the pile hole and prior to load.

In FIG. 1 a pile anchor mooring assembly is illustrated as including a flexible, tubular housing 10, such as made from the plastic product, trademarked "NYLON" and manufactured by E. I. duPont de Nemours, and a flexible outer housing 20, of the type manufactured from steel cord, rubberized hose. An anchor cable 12 extends axially of housing 10 for embedment in anchor stock 16 by means of enlarged head 18. The anchor stock includes a pair of flukes 38 and 40 extending through apertures 22 in the housing wall and pivoted as at 42 in the base of the anchor stock.

An elongated axial extension 44 of the anchor stock extends downwardly, so as to support pivoted links 46 and 48, having respective housing wall engaging plates 50 and 52. The bellis assembly 14 includes pivoted links 24, 26, 28 and 30 pivoted to the top bearing plate 46 as at 32 and pivoted to the anchor stock as at 34 by means of vertical lug 36. The free ends of the pairs of links may include inner wall engaging plates 54 and 56.

The anchor stock elongated axial extension 44 extends through median bearing plate 60. Upper bearing plate 16, median plate 60 and lower bearing plate 62 may be secured in the housing by means of threaded bolts 64 or the like.

Figure 2:
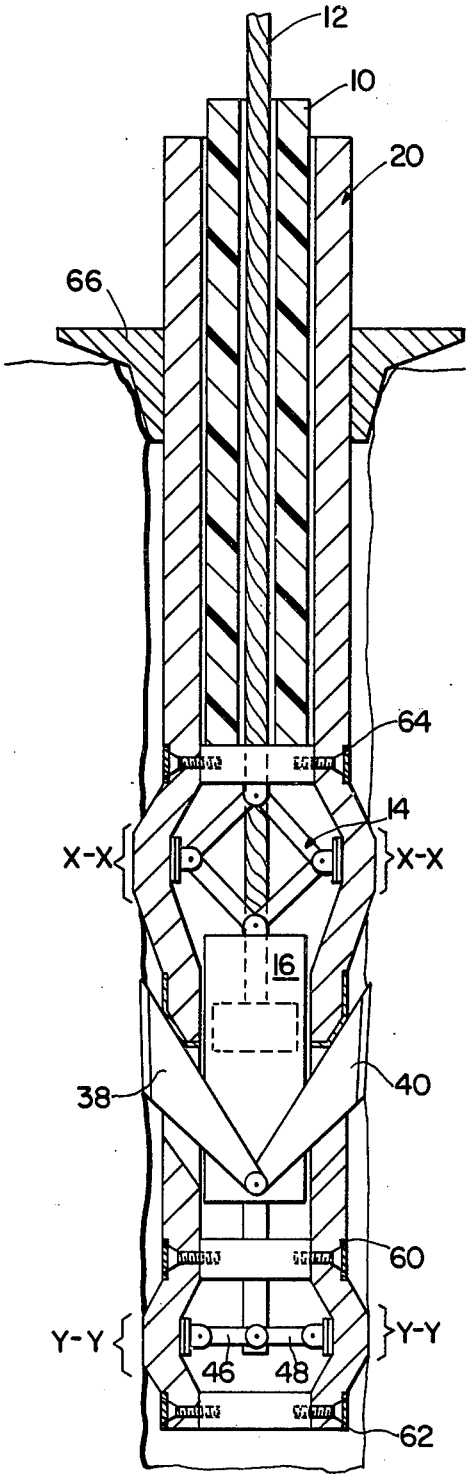
FIG. 2 is a partially fragmentary, vertical elevation, showing the pile anchor under load with the bellis assembly and the lower pair of pivoted links expanding the walls of the flexible housing, while the anchor flukes are pivoted to engage the sides of the pile hole.

As illustrated in FIG. 2, placing of a load on the anchor cable 12 reciprocates anchor stock 16 within flexible housing 10 so as to expand bellis assembly 14 against the inner walls of the housing, thus distending the housing as at x-x to engage the sides of the piling hole. Simultaneously, the lower link assembly 46, 48 engages the sides of housing 20 as at y-y. This reciprocation of the anchor stock also pivots flukes 38 and 40 for independent engagement of the fluke blades with the walls of the pile hole.

An anti-chafing collar 66 may encircle the housing at the piling hole top to prevent chafing on the housing, as well as deterioration of the piling hole. Manifestly, various types of expanders may be employed without departing from the spirit of the invention.

I claim:

1. A pile anchor for moorings comprising:

A. A flexible elongated housing;

B. An anchor stock reciprocably positioned within the bottom of said housing and including:

i. a pair of flukes pivoted at their inner ends to said stock and extending outwardly through apertures in said housing, so that their outer ends are engagable with the surrounding seabed;

C. An anchor cable extending axially within said housing and embedded at its lower end within said anchor stock;

D. A bellis expander assembly pivoted at its top within said housing and said bellis at its bottom being pivoted to said anchor stock, so that two pairs of free ends engage the walls of said housing as expanders during longitudinal reciprocation of said cable and said anchor stock.

2. A pile anchor for moorings as in claim 1, said bellis assembly being of sufficient length to expand the walls of said housing upon placing of longitudinal load upon said anchor stock and cable.

3. A pile anchor for moorings as in claim 1, including a pair of expansible links pivoted at their bottom ends to said anchor stock and engagable with the inner walls of said housing at their upper ends as an expander assembly.

4. A pile anchor for moorings as in claim 3, including

E. An upper bearing plate positioned within said housing as a bearing for said bellis expander top.

5. A pile anchor for moorings as in claim 4, said anchor stock including a lower axial extension upon which said pair of expansible links is pivoted.

6. A pile anchor for moorings as in claim 5, including a median bearing plate engagable with the base portion of said anchor stock and having an axial aperture through which said anchor stock lower axial extension extends.

7. A pile anchor for moorings as in claim 6, including a bottom bearing plate supported within said housing and abuttable with the anchor stock extension.

8. A pile anchor for moorings as in claim 7, including a flexible outer housing surrounding said inner housing and having apertures for lateral, outward extension of said flukes.

9. A pile anchor for moorings as in claim 8, said outer housing being of steel cord rubberized hose.

10. A pile anchor for moorings as in claim 9, each pair of said bellis free ends including a wall engaging plate at their lateral extremities, so as to abut the inner wall of said flexible housing.

11. A pile anchor for moorings as in claim 10, median portions of said flukes engaging said housing, such that said housing serves as a limit of longitudinal movement of said flukes upon placement of load upon said anchor cable.

* * * * *